US005396840A

United States Patent [19]

Olson

[11] Patent Number: 5,396,840

[45] Date of Patent: Mar. 14, 1995

[54] MANUAL BAR CODER

[76] Inventor: Richard C. Olson, 3601 Devilwood Ct., Fairfax, Va. 22030

[21] Appl. No.: 187,065

[22] Filed: Jan. 27, 1994

[51] Int. Cl.[6] ..... B41J 1/22

[52] U.S. Cl. ..... 101/45; 101/35

[58] Field of Search ..... 101/45, 35, 114, 129; 235/65, 66, 79.5, 88 R

[56] References Cited

U.S. PATENT DOCUMENTS

| | | | |
|---|---|---|---|
| 1,510,481 | 10/1924 | Koester | 235/65 |
| 1,898,398 | 2/1933 | Sabatini | 235/66 |
| 3,275,235 | 9/1966 | Balch | 235/79.5 |
| 4,026,463 | 5/1977 | Betzler | 235/88 R |
| 4,181,090 | 1/1980 | Calise | 235/88 R |
| 4,399,353 | 8/1983 | Adkins et al. | 235/88 R |

FOREIGN PATENT DOCUMENTS

| | | | |
|---|---|---|---|
| 8202715 | 2/1984 | Netherlands | 235/88 R |
| 9000071 | 8/1991 | Netherlands | 235/66 |

*Primary Examiner*—Edgar S. Burr
*Assistant Examiner*—Anthony H. Nguyen
*Attorney, Agent, or Firm*—Terrance L. Siemens

[57] ABSTRACT

A manually set bar code generating device is easily attachable to a mail container such as an envelope. A housing rotatably mounts a series of concentric circular rings which are imprinted with bar code characters on one side and with alphanumeric characters on a diametrically opposite side. The housing includes diametrically opposed windows that expose a bar code character on one side while exposing its alphanumeric counterpart on the other side. Each single ring thus sets up a single character of a bar code sequence. The series of rings sets up the desired sequence of bar code characters in one window as the desired sequence of alphanumeric characters is dialed into place in the opposite window. The side-by-side rings are independently rotatable about a central axis of the housing. Rotation of the individual rings is accomplished by inserting a pointed instrument into one of a series of depressions in the ring. Protrusions on the bottom of the ring snap into recesses in the housing to accurately position the indicia in the windows. Tapered grooves in the housing mate with conical side walls of the rings to maintain precise ring-to-ring spacing.

11 Claims, 2 Drawing Sheets

MANUAL BAR CODER

BACKGROUND OF THE INVENTION

1. Field of the Invention

The present invention relates to bar coding items for the purposes of automated mailing. More specifically, it relates to a manual bar coder suitable for mounting on a mailing envelope or other mail container. It should be understood from the outset that the term "mail" as used herein is used in its broadest sense and is meant to include the routing of both paper and goods from one location to another. The actual delivery of the mail may be accomplished by anything from a human carrier, as in the case of a postal service, to a series of computer controlled power conveyors in an automated warehouse. This manual bar coder will facilitate the delivery of mail by making it a simple matter to place precise, machine readable, bar codes on any item. The machine readable codes can then be used to control automatic sorters and the like.

It is contemplated that the device of this invention could be used in conjunction with almost any kind of container used for transporting any kind of goods. Railroad cars could be temporarily encoded with a device of this nature to indicate the contents and/or destinations. Shipping boxes or storage cartons could be similarly encoded in warehousing operations. Parts destined for particular points in an assembly operation could be addressed with this invention so as to facilitate their timely and accurate arrival. As a final example of the numerous potential uses for this device, it is submitted that it could be permanently attached to luggage as an attractive replacement for the currently used ugly and inconvenient bag tags. The bar coding device is reusable many times and thus may be used for several different purposes throughout it's lifetime.

Thus it can be seen that the potential fields of use for this invention are myriad and the particular preferred embodiment described herein is in no way meant to limit the use of the invention to the particular field chosen for exposition of the details of the invention.

A comprehensive listing of all the possible fields to which this invention may be applied is limited only by the imagination and is therefore not provided. Some of the more obvious applications are mentioned herein in the interest of providing a full and complete disclosure of the unique properties of this previously unknown general purpose article of manufacture. It is to be understood from the outset that the scope of this invention is not limited to these fields or to the specific examples of potential uses presented hereinafter.

2. Description of the Prior Art

In the delivery of mail and products it has become important to maintain some type of accurate information control on the destiny of large amounts of items. An early attempt at this was the institution of the Zip Code System of addressing used by the United States Postal Service. Zip Codes consist of a unique five, nine, or eleven digit Arabic numeral for each postal zone in the nation. Zip Codes were easy to read manually by sorting personnel and provided a significant improvement in the efficiency of mail delivery. To achieve further improvement it has been determined that some sort of machine readable code would be superior. Although fully flexible optical character recognition machines are under development that will read normal typed or handwritten characters, such as zip codes, the time when such machines will be inexpensive and reliable appears to be far in the future.

As an interim step to full and reliable optical character recognition or "reading" machines, there have been developed bar codes. A bar code is a series of bars of varying heights and/or widths which encode information. Today's consumer is literally besieged with bar codes. They are carried on, or attached to, practically every item sold in the marketplace. A limitation of the use of bar codes for the routing of mail is that the bars must be precisely positioned on the envelope and be of consistent size and shape and sufficient opacity in order to be properly read by the scanning machine. Therefore, there is not a human alive that can sit down and write a bar code. Bar codes are generated by machines for machines. The closest thing to a bar code writer known in the prior art is a hand held computer printer which will print out a bar code strip upon entry of the information into a keyboard.

The prior art leaves a desperate need for a device, useable by the average person, which will create or "write" accurate machine readable bar codes with equipment as simple as a pencil. My invention addresses this void by providing just such a unique and simple bar code writer useable by anyone. A search of the prior art in this field was conducted at the United States Patent Office. The prior patents discovered are discussed below. As will be seen, the simplicity and effectiveness of my invention is not rivaled in the prior art.

U.S. Pat. No. 5,064,222, issued to Legault on Nov. 12, 1991, teaches the use of pressure-transferrable, "rub-off" bar codes for envelopes for the purpose of utilizing optical bar code recognition machinery in the routing of mail. The critical problem of precision spacing between individual character codes is not addressed except to state the user is to align the edge of the sheet with the edge of the envelope. Each rub-off sheet is useable but once. By contrast, the device of the instant invention automatically provides a precisely positioned, preprinted, bar code and the device may be used over and over as many times as desired.

U.S. Pat. No. 5,188,164, issued to Aaron on Feb. 23, 1993, shows a hand-held electronic calculator and printer for printing postal bar codes from keyboard input. Each printed bar code is useable but one time and the device requires an electrical power source for operation. By contrast, the device of the instant invention is reusable many times and requires no external power source, being both manually powered and operated.

U.S. Pat. No. 4,993,624, issued to Schlich on Feb. 19, 1991, shows a two way bar code window envelope to facilitate mass and return mailings. The bar codes for both the outgoing and return mailings must be preprinted by a computer at the source. No manual creation of a bar code is possible. By contrast, the device of the instant invention provides for the manual generation of precision bar codes by an unsophisticated user at the sending site without the use of computer equipment.

U.S. Pat. No. 5,169,061, issued to Buescher on Dec. 8, 1992, shows another two-way bar code window envelope to facilitate mass and return mailings. The bar codes for both the outgoing and return mailings must be preprinted by a computer at the source. No manual creation of a bar code is possible. By contrast, the device of the instant invention provides for the manual generation of precision bar codes by using nothing more than a pointed instrument, such as a pencil, at the sending site without the use of computer equipment.

It will be noted that all the prior art devices require a computer and printer combination to generate the bar codes for each item routed. In this sense they are not manual bar coders as is my invention which manually sets up a precision bar code each time it is used and which may be used a multiple number of times to route a multiple number of items. Also, it is noted the prior art devices are all directed toward the addressing of paper mail. My device, however, being easily attachable to any container or product, is useful for addressing or identifying a much broader spectrum of goods. As will be seen, the simplicity and effectiveness of my invention is not rivaled in the prior art.

None of the above inventions and patents, taken either singly or in combination, is seen to describe the instant invention as claimed.

SUMMARY OF THE INVENTION

The good news about bar codes is that they are easily read by machines called scanners. The bad news is that they are practically impossible for humans to read or create. There are several versions of bar codes on the market ranging from the universal product code (UPC) to the postal "Postnet" code. Unfortunately, all bar codes require precision spacing between characters and clarity to be effectively read by scanners. The precision required is far too great to be manually transcribed by the average person with a pen and paper. The instant invention provides an apparatus allowing for precise manual formation of bar code sequences.

Briefly, the invention comprises a manually set bar code generating device which is easily attachable to a mail container such as an envelope. The device may be secured to an envelope by any conventional means. A housing rotatably mounts a series of concentric circular rings which are imprinted with bar code characters on one side and with alphanumeric characters on a diametrically opposite side. The housing includes diametrically opposed windows that expose a bar code character on one side while exposing its alphanumeric counterpart on the other side. Each single ring thus sets up a single character of a bar code sequence. The series of rings sets up the desired sequence of bar code characters in one window as the desired sequence of alphanumeric characters is dialed into place in the opposite window. Either set of characters is suitable for machine reading with the bar code characters readable, at the present time, by less expensive machines. The side-by-side rings are independently rotatable about a central axis of the housing. Rotation of the individual rings is accomplished by inserting a pointed instrument into one of a series of dimples in the ring. Protrusions on the bottom of the ring snap into recesses in the housing to accurately position the indicia in the windows. Tapered grooves in the housing mate with conical side walls of the rings to maintain precise ring-to-ring spacing.

Accordingly, it is a principal object of the invention to provide a new and unique manual bar coder which overcomes the disadvantages of the prior art in a simple but effective manner.

It is a major object of this invention to provide a new manual bar coder which is easily attached to and detached from general purpose mail containers, be they envelopes, luggage, freight containers, vehicles, transport pallets, or any other device for temporarily storing articles during transport.

It is another object of the invention to provide such a manual bar coder which will simultaneously display bar codes and their alphanumeric translations which are infallibly accurate.

It is another object of the invention to provide such a manual bar coder which will display bar code characters in a precision array suitable for fault free scanning.

It is another object of the invention to provide such a manual bar coder which is reusable a multitude of times.

It is another object of the invention to provide such a manual bar coder which is easy to reset to different bar codes without the use of computers and/or printers.

It is another object of the invention to provide such a manual bar coder which substitutes for the placement or printing of any symbols on the article it is used to route.

Finally, it is a general goal of the invention to provide improved elements and arrangements thereof in an apparatus for the purposes described which is inexpensive, dependable and fully effective in accomplishing its intended purposes.

The present invention meets or exceeds all the above objects and goals. Upon further study of the specification and appended claims, further objects and advantages of this invention will become apparent to those skilled in the art.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENT

Figure 1:
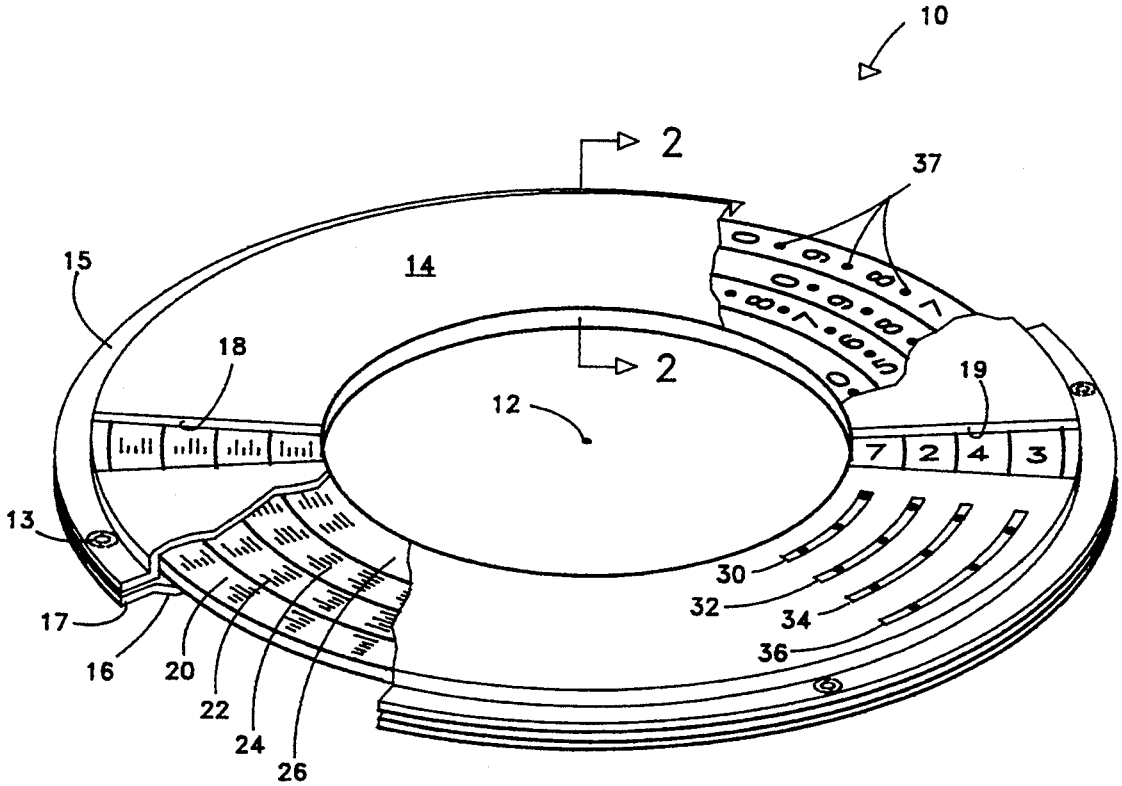
FIG. 1 is a partially broken away perspective view of the invention.
Figure 2:
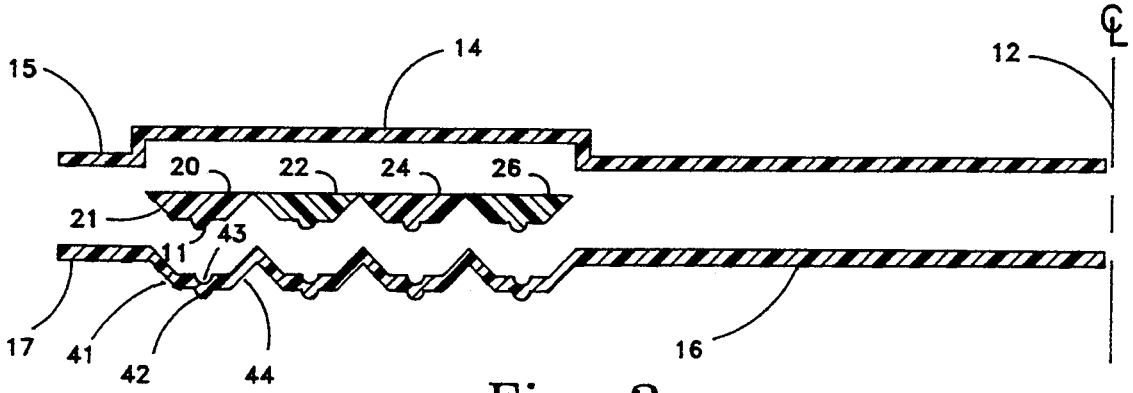
FIG. 2 is a cross-sectional view of the embodiment of FIG. 1 taken along line 2—2 of FIG. 1.
Figure 3:
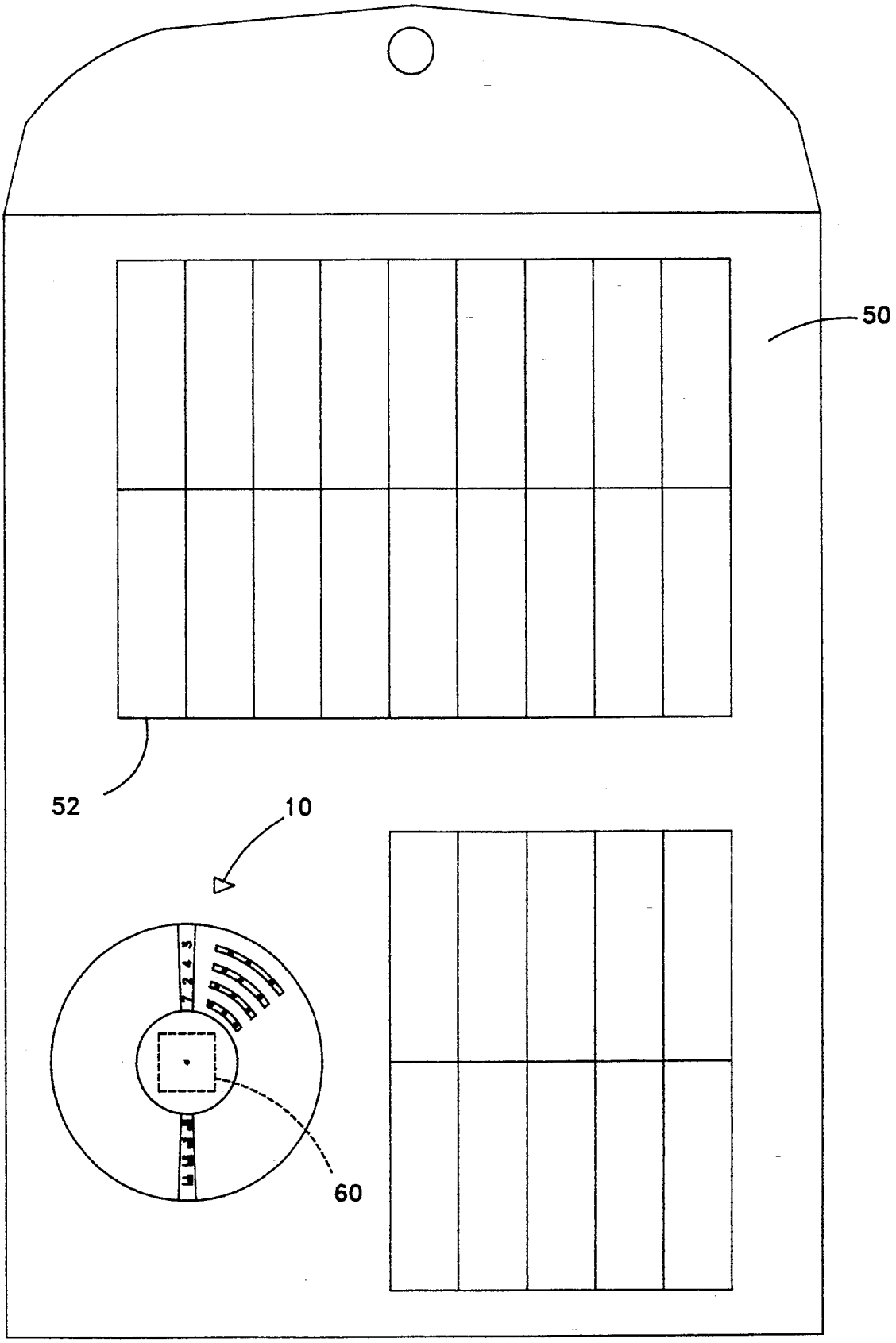
FIG. 3 is an environmental view of the invention in a typical use attached to a mailing envelope.

The present invention is indicated generally at 10 in FIG. 1 which represents a preferred embodiment. Referring generally to FIGS. 1, 2 and 3, the improved and unique bar coder will now be described in detail. The operative portion of the mechanism comprises four concentric rings 20, 22, 24, and 26 rotatable in complementary conical grooves such as 41 and 44 formed in a lower housing portion 16 as shown in FIG. 2. Of course, more or fewer rings could be used as the bar coding task dictates. The rings are held in the grooves by upper housing portion 14. The upper 14 and lower 16 housing portions are preferably made from thin flexible plastic and the rings are molded of hard plastic material.

The outer rim 15 of the upper housing 14 is formed so as to contact the outer rim 17 of lower housing portion 16 so as to facilitate rigid connection of the two portions while leaving room for the plastic rings to freely rotate between the two portions. As seen in the Figures the outer rims are stepped toward one another for this purpose. Of course the upper housing portion could be made flat if the stepped rim of the lower portion were offset an appropriate amount. Fastening means 13 are shown diagrammatically spaced around the periphery of the outer rims 15 and 17. The fastening means may consist of heat welds, rivets, glue, or any other conventional form of permanent fastening suitable for facing sheets of material. It is also possible that removable fastening means such as screws, artificial briar material, or reusable adhesive, could be used between the upper and lower housing portions. Removable fastening means would be needed if it were desired to replace the rotating rings with differently coded rings as discussed more fully later.

The upper housing portion 14 is shown as having a raised portion directly above the rings. It is to be understood that this raised portion is entirely arbitrary and may be omitted if desired. In other words the upper surface may be simply a flat, circular sheet. Required on the upper housing surface, however, are at least two cut out portions such as at 18 and 19 forming windows through which the upper surface of the rings is exposed. The windows 18 and 19 extend radially far enough to expose a portion of all of concentric rings in the device. The windows extend circumferentially just far enough to expose a single character indicia on each ring as more fully described later. The housing portions are shown as generally circular so as to efficiently enclose the circular rings but, of course, any aesthetically pleasing overall shape could be used.

The lower portion 16 of the housing is formed with depressed concentric grooves such as shown at 41, 44 of FIG. 2. Side walls 41, 44 of the outside groove are tapered toward one another in a downward direction so as to fit similarly tapered side walls 21 of ring 20. The complementary tapers form complementary conical surfaces in groove side walls and the ring side walls. This will serve to precisely center each of the rings in its corresponding groove. A flat bottom surface of each groove serves to support a flat bottom surface of each ring. Interrupting the flat bottom surface of each ring are a series of circumferentially spaced dimples or protrusions such as shown in cross-section at 11 in FIG. 2. The flat bottom surface of the grooves is formed with complementary depressions for accommodating the dimples such as shown at 43 in FIG. 2. As a ring 20 is rotated in a groove the dimples 11 will successively become engaged with depressions 43. Dimples 11 will cause the ring to stop at definite points at the precise locations defined by the depressions 43. The material used for the depressions and dimples is soft enough so as to form a precise circumferential stop point for the ring and yet allow the ring to be rotated with a moderate degree of tangential force. Together, depressions 43 and dimples 11 form detent means for holding the rings in fixed position relative to the housing until released by the application of force to the rings.

The concentric rings 20, 22, 24, and 26 each have tapered side walls and a bottom surface as previously described. In addition, each ring has a flat upper surface which is imprinted or embossed with indicia. In the illustrated embodiment the indicia are alphanumeric characters on one side of the ring and corresponding bar code representations of such characters on a diametrically opposed side of the ring. Therefore, as an alphanumeric character on a ring is moved so as to appear through one window, the corresponding bar code for that character will appear in the diametrically opposite window. It is contemplated that the windows and corresponding codes need not be diametrically opposed and that other windows showing other related information might be formed in the upper housing portion. As each one of the series of concentric rings is adjusted to the appropriate character the concentric nature of the rings will allow any given sequence of characters to be exposed in one window. The corresponding bar code for that sequence of characters will then appear in the diametrically opposite window.

The means for manually rotating the rings to the appropriate angular position will now be described. To this end, narrow circumferential slits 30, 32, 34, and 36 are formed in the upper housing portion 14 just above the center of the top face of each ring. Small indentations 37 are molded into the top face of the rings so as to lie directly below the corresponding circumferential slit. Small indentations 37 are arranged between the successive indicia characters on the face of the ring. Any small pointed instrument, such as a pencil, may be inserted into one of the circumferential slits and into one of the small indentations. Moving the so inserted pencil along the slit will thus rotate the corresponding ring in the direction of the pencil movement. Thus the rings may be easily rotated to the desired position to simultaneously form the desired sequence of characters and the corresponding bar code sequence. The artisan will recognize there are many other ways to impart the desired rotation to the rings. For example, it would be possible to have ring-attached manipulating levers extending through the circumferential slits so as to be simply pushed by the finger of the user. The details of the ring rotating means are open to many design variations well within the skill of the artisan and further possible variations will not be discussed here.

The angular extent of the ring adjusting slits is shown as enough to move the rings by at least two characters for each insertion of the pointed operating instrument. It is contemplated the slits could be longer so as to more quickly adjust a wider range of characters, or shorter so as to increase the structural rigidity of the housing. Also, it is noted that the slits for adjacent rings need not be radially adjacent one another as they are merely shown that way for clarity of illustration. A further design variation would be to extend the ring rotating means below or to the side of the housing as would be apparent to those of ordinary skill in the art.

Turning now to FIG. 3, a typical use for the manual bar coder is illustrated. There is shown a typical mailing envelope 50 with manual bar coder 10 attached to a face thereof by attachment means 60. The attachment means for securing the invention could consist of any conventional means. Imprinted on the face of the envelope are rulings which may be used for writing routing information in the conventional manner. If it is desired to use the envelope in combination with automatic routine machinery, the user need only dial in the appropriate address code on coder 10. Of course, as previously discussed it would be possible to permanently or temporarily attach the bar coder to any sort of mail or package container. The overall size and outline of the bar coder is contemplated to be chosen with regard to the particular container to which it is to be attached.

It is to be understood that the provided illustrative examples are by no means exhaustive of the many possible uses for my invention. As final examples of the wide ranging uses for my coder it is suggested that the codes involved need not at all be limited to bar codes. The codes set in one window could represent characters in one language whereas the other window could simultaneously display the corresponding characters in another language. The characters in one window could represent a simple mathematical problem with the other window representing the solution. Thus it can be seen that the manual coder could also be a powerful educational tool.

From the foregoing description, one skilled in the art can easily ascertain the essential characteristics of this invention and, without departing from the spirit and scope thereof, can make various changes and modifications of the invention to adapt it to various usages and conditions. For example, the artisan could easily ascertain that the clicking of the ring from one precise angular position to another could as well be accomplished with simple mating serrations as with the illustrated dimples and depressions.

It is to be understood that the present invention is not limited to the sole embodiment described above, but encompasses any and all embodiments within the scope of the following claims:

I claim:

1. A manual coder means for converting and displaying a first set of recognizable indicia to a corresponding second set of coded indicia comprising;

indicia carrying means, upon which are imprinted a series of both said first and said second sets of indicia;

housing means for mounting said indicia carrying means for movement therein;

window means in said housing means comprising a first and a second circumferential separated aperture for simultaneously exposing to view one of said series of said first set of recognizable indicia in said first aperture and a corresponding one of said series of said second set of coded indicia in said second aperture;

manually operable movement means for moving said indicia carrying means within said housing means so as to expose to view a selected one of said first set of indicia in one of said apertures and simultaneously expose to view a corresponding one of said second set of coded indicia in said second aperture.

2. The manual coder of claim 1 further comprising;

detent means for precisely locating and holding said indicia in place directly in line with said window means as said indicia carrying means are moved with said manually operable movement means; and attachment means for mounting said manual coder on a mailing container.

3. The manual coder of claim 1 wherein said indicia carrying means comprises;

a group of adjacent flat concentric rings with each said ring being imprinted on one flat face with said first set of recognizable indicia in one sector thereof and being imprinted with said second set of coded indicia in an opposite sector thereof;

said rings being rotatable in said housing means; wherein when one of said rings is rotated so as to expose one of said first set of recognizable indicia in said one of said apertures a corresponding one of said second set of coded indicia will be exposed in said second aperture, and when each of said adjacent rings are so rotated, a sequence of said recognizable indicia will be exposed in said one of said apertures and a corresponding sequence of said second set of coded indicia will be exposed in said second aperture.

4. The manual coder of claim 3 further comprising;

detent means for precisely locating and holding said indicia in place directly in line with said window means as said indicia carrying means are moved with said manually operable movement means said ratchet means comprising protrusions on a face of said rings which snap into corresponding depressions in said housing means; and attachment means for mounting said manual coder on a mailing container.

5. The manual coder of claim 3 wherein said sequence of recognizable indicia and said sequence of coded indicia are machine readable.

6. The manual bar coder of claim 5 wherein said sequence of recognizable indicia and said sequence of coded indicia are displayed in said first and said second apertures, respectively, in a side-by-side relationship so as to be read in a radially outward direction.

7. The manual coder of claim 1 wherein said set recognizable indicia comprises alphanumeric characters and said second set of coded indicia comprises corresponding bar codes for said alphanumeric characters.

8. The manual coder of claim 3 wherein said sequence of recognizable indicia comprises alphanumeric characters and said sequence of coded indicia comprises corresponding bar codes for said alphanumeric characters.

9. The manual coder of claim 2 wherein said mailing container is an envelope.

10. The manual coder of claim 2 wherein said one sector and said opposite sector are quadrants.

11. The manual coder of claim 3, wherein said manually operable movement means comprises;

multiple depressions circumferentially positioned around each ring, and narrow slits in said housing means which expose at least two depressions on each ring, there being one slit for each said ring, wherein a user can insert a pointed instrument through said slit corresponding to one of said rings into one of said depressions in said ring and rotate said ring by moving said pointed instrument in said slit.

* * * * *